US007280023B2

(12) United States Patent
Hendel

(10) Patent No.: US 7,280,023 B2
(45) Date of Patent: Oct. 9, 2007

(54) IGNITION COIL HAVING AN IMPROVED POWER TRANSMISSION

(75) Inventor: Horst Hendel, Berlin (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 10/528,133

(22) PCT Filed: Sep. 16, 2003

(86) PCT No.: PCT/EP03/10307

§ 371 (c)(1),
(2), (4) Date: Mar. 13, 2006

(87) PCT Pub. No.: WO2004/027794

PCT Pub. Date: Apr. 1, 2004

(65) Prior Publication Data

US 2006/0192644 A1 Aug. 31, 2006

(30) Foreign Application Priority Data

Sep. 16, 2002 (DE) ..... 102 42 879

(51) Int. Cl.
*H01F 27/02* (2006.01)

(52) U.S. Cl. ..... 336/92; 336/90; 336/96

(58) Field of Classification Search ..... 336/90, 336/92, 96

See application file for complete search history.

(56) References Cited

U.S. PATENT DOCUMENTS

| | | | | |
|---|---|---|---|---|
| 1,474,597 | A | 11/1923 | Atwater | |
| 4,099,510 | A * | 7/1978 | Perrier et al. | 123/634 |
| 5,506,561 | A | 4/1996 | Heritier-Best | |
| 5,703,556 | A * | 12/1997 | Kikuta et al. | 336/83 |
| 6,094,122 | A * | 7/2000 | Sexton | 336/96 |
| 6,650,219 | B1 * | 11/2003 | Widiger et al. | 336/198 |
| 2002/0014940 | A1 | 2/2002 | Kondo et al. | |

FOREIGN PATENT DOCUMENTS

| | | |
|---|---|---|
| JP | 59061908 | 4/1984 |

* cited by examiner

*Primary Examiner*—Anh Mai
(74) *Attorney, Agent, or Firm*—Barley Snyder LLC

(57) ABSTRACT

The present invention relates to an ignition coil for ignition systems, in particular a rod ignition coil for internal-combustion engines, comprising at least one primary winding and at least one secondary winding, a high voltage being induced in the secondary winding when current flows in the primary winding. A ferromagnetic core is surrounded in part by the primary winding and the secondary winding and one of the two windings is additionally surrounded at least in part by the other. To provide an improved ignition coil which ensures increased reliability in operation and energy efficiency and a reduced risk of overheating during operation, at least one of the windings comprises at least one portion having an elevated winding density relative to the remaining winding density, the diameter of the innermost turns in the at least one portion being smaller than the diameter of the innermost turns in the remaining winding portions.

20 Claims, 3 Drawing Sheets

IGNITION COIL HAVING AN IMPROVED POWER TRANSMISSION

This application is a National Stage Application filed under 35 U.S.C. § 371 of PCT/EP2003/010307, filed on Sep. 16, 2003, which claims priority of DE Application No. 10242879.4, filed Sep. 16, 2002.

FIELD OF THE INVENTION

The present invention relates to an ignition coil for ignition systems, in particular a rod ignition coil for internal-combustion engines.

BACKGROUND

Ignition coils of this type are conventionally configured to have an extremely minimized volume and weight, and they are predominantly used in internal-combustion engines in which each combustion cylinder is equipped with its own ignition coil and rests directly on the spark plug without expensive mounting elements. Ignition coils of this type are also known as single-spark ignition coils or rod ignition coils and have to be particularly vibration-resistant and able to withstand high temperatures, as they make direct contact with the heated engine block, which generates vibrations.

In addition to the primary and secondary induction coil, a single-spark ignition coil of this type comprises a specific magnetic circuit and may also include an electronic circuit element, for example an output stage which is connected to the induction coils to form a unit. Two plug connectors, one for connection of the high-voltage terminal to the spark plug and one plug connector that generally has four pins for the power supply from the wiring and the activation line complete an ignition coil of this type. The ignition systems are activated by the engine electronics, which determine the moment of ignition from a plurality of dynamic engine characteristics.

Single-spark ignition systems of this type have advantages over an ignition system that is powered by a single ignition coil and operates by the distributor principle. High-voltage lines, including the mechanical drive and distributor assembly, which is adversely affected by wear and contamination during operation and which influence the moment of ignition or impair the ignition power, may be dispensed with.

The physical operating principles of energy transmission, described hereinafter, apply to ignition coils of this type. An externally powered primary coil and the associated build-up of a magnetic field, which leads to an inductive transfer to the secondary winding when the primary current is interrupted, are used as a starting point.

The secondary current in the high-voltage portion is built up merely by the induction principle from the reduction in magnetic flux brought about by the disconnection of the primary current and the associated change in magnetic flux. However, this build-up of current and the incipient discharge do not take place continuously, but in four phases, according to the physical parameters that are predominant in each case. The build-up of current due to the capacitance of the secondary winding begins before the actual discharge via the spark plug electrodes directly after initiation of the reduction in primary current.

The first phase of the build-up of secondary current begins without delay when the reduction in the primary current commences. The charge is shifted according to the capacitance of the secondary winding with associated formation of corresponding electric fields on the spark plug electrodes, which then bring about the actual power breakdown. A considerable reduction in primary current, starting from the maximum value of the primary current, is required for generating the electric fields necessary for the secondary power breakdown. It is approximately 30% with a duration of action of 2 to 5 μsec and is determined by the ignition coil concept and the electronic switch, which influences the speed of disconnection of the primary current.

The equation $$U_{indu} = N \cdot \frac{\Delta\Phi}{\Delta t} \text{ or}$$

$$U_{indu} = L \cdot \frac{\Delta I}{\Delta t}.$$

applies to induction and self-induction processes with loss-free observation and for an open circuit.

The second phase of the secondary current is a sudden increase of a resistive nature associated with the power breakdown. It has substantially no inductive cause and results from the capacitive discharge of the secondary winding charge that has accumulated in the first phase.

Pure induction processes are predominant in the third phase of the secondary increase in current, the change in magnetic flux acting as a difference in the associated ampere turns (primary side decreases, secondary side increases) due to the further reduction in the primary current and the resultant increase in the secondary current, and the increase in the secondary current is consequently flatter, even though the reduction in the primary current remains uniform at this moment. It flattens only toward the end of the reduction in primary current, and the increase in the secondary current attains its maximum value in a soft run-out. The physical principle of the increase in the secondary current is manifested in that, in each phase of the increase, the maximum number of secondary ampere turns that can ever be adjusted is the same as the number of ampere turns that have previously been induced on the primary side, because only the magnetic field (originally produced by the primary winding) occurs as the energy parameter during induction and, according to the principle of energy conservation, cannot propagate itself, even with such a rapid reduction in primary current.

Therefore, the following relationship applies to the phase of increase in the secondary current, with a reduction in the primary current and loss-free observation:

$$N_{secondary} \times dI_{secondary} \leq N_{primary} \times dI_{primary}$$

This physical principle acts substantially independently of the speed of the primary switching operations, providing that sufficient voltage is induced to overcome the ohmic resistance. These procedures also take place independently of the presence of an iron circuit.

The fourth phase of the secondary current curve represents the magnetic free-run of the iron circuit, in particular of the magnetic coil core, the counter-induction of the secondary coil being predominate for the period of action of the magnetic free-run. The primary winding is already at zero current in this phase, and an influence on the secondary side, if significant on account of the smallness, would only be possible via capacitance.

All of the formerly known compact ignition coils, of the type shown, for example, in DE 199 62 279 A1, DE 199 27

820 C1, WO 99/36693, DE 199 50 566 A1, EP 1 111 630 A2 or EP 0 959 481 A2, run the risk of overheating during operation. This is due to the self-heating, predominantly by the considerable current load (15 amperes) of the primary winding, but also due to the power dissipation of the secondary winding. To this is added the exposure to heat due to the relatively high ambient temperature of the engine block (up to 125° C.). The lower thermal value of compact ignition coils further complicates the attainment of a state of equilibrium at a justifiably controlled temperature (maximum 160° C.), in particular during continuous operation with maximum ignition frequency.

European patent application EP 0 959 481 A2 discloses an embodiment of a compact rod ignition coil, in which the risk of overheating, in particular of the electronic output stage, is to be reduced, so that reliable operation is achieved even when it is exposed to high temperatures. Overheating is prevented passively by attempting to isolate the individual sources of heat by means of a separating gap. However, this solution has the drawback that the actual production of undesirable heat is not counteracted.

It is accordingly an object of the present invention to provide an improved ignition coil for ignition system, in particular a rod ignition coil for internal-combustion engines, which ensures increased reliability in operation and energy efficiency as well as a lower risk of overheating during operation.

SUMMARY

The present invention is based on the recognition that the exposure of an ignition coil to high temperatures can be actively reduced by observing the individual heat sources and reducing the dissipation of electric and magnetic power at the induction coils. This increase, according to the invention, in the efficiency of energy transfer is achieved by constricting the magnetic field in at least one portion having an elevated winding density relative to the remaining winding density, in which the diameter of the innermost turns is smaller than in the remaining winding portions.

By passing a relatively low current through the primary winding, the electronic output stage is also thermally and electrically relieved and the reliability of operation therefore increased. The configuration of the ignition coil according to the invention also affords the advantage of reducing the overall volume by about 15% relative to the currently known comparable ignition coil designs. A conventional pot ignition coil accordingly has, for example, an overall volume of more than 300 $cm^3$ (diameter 5.9 cm, length 11.5 cm). The rod ignition coil configured according to the invention manages with a volume of approximately 30 $cm^3$ (diameter approximately 2.2 cm, length approximately 8.2 cm), including the high-voltage terminal.

Finally, the solution according to the invention affords the advantage that the firing power is subject only to relatively slight variations over the entire operating temperature range (−40° C. to a maximum of +180° C.).

Advantageous developments of the invention are described in the sub-claims.

According to an advantageous development, the secondary winding is so arranged relative to the primary winding that each portion having an elevated winding density on one winding corresponds to a portion of remaining winding density on the other winding in the axial direction. Energy transfer can be significantly improved by this penetration of the volume of the two windings.

According to a further advantageous embodiment, the primary winding and secondary winding are so arranged that the primary winding surrounds the secondary winding and that the portion with elevated winding density is an initial and/or final portion of the primary winding. The secondary winding is arranged in the remaining winding portion of the primary winding. This affords the advantage that the high-resistance secondary winding is arranged in the vicinity of the core and the low-resistance primary winding, which does not require separate insulation, is arranged externally. A particularly small overall diameter of the ignition coil can thus be achieved. Basically, an efficiency-increasing effect may be achieved by the mere provision of only one portion having an elevated winding density and reduced diameter of the innermost turns. This region is expediently provided at the final run-out of the primary winding, remote from the high voltage, due to the advantages in terms of insulation. On the other hand, if such a region having elevated winding density and reduced diameter of the innermost turns is provided both in the initial portion and in the final portion of the primary winding, this has the advantage that the secondary winding is magnetically surrounded on three sides.

If a pre-winding and/or a final winding, which is surrounded by the initial and/or final portion of the primary winding, is further provided on the secondary winding, the available volume can be used particularly effectively.

If a flat wire winding is used for at least one of the windings, instead of the conventional round wire winding, the current density can be increased and the constriction effect on the magnetic field can therefore be further increased. The use of flat wire has the further advantage over a round wire that a greater coil density can be achieved and the necessary number of turns for the primary winding can therefore be produced with lower resistance, without the need for a greater coil volume. The extensive contact between the individual turns made of flat wire also allows a much better dissipation of heat than a round wire with smaller contact area between the turns.

For optimum guidance of the magnetic field, the ignition coil can further comprise a soft-magnetic sleeve which surrounds the windings and the core.

The secondary winding may be segmented to improve the electric strength.

To ensure the insulation resistance toward the primary winding, while at the same time maintaining minimum volume occupancy, the coil heights of these secondary segment windings may be configured to decrease in the coil height in the manner of a cascade. The wall thicknesses of the insulation toward the primary winding are increased according to the increasing high voltage from segment to segment.

Furthermore, if the final run-outs of the secondary winding are guided in an axial direction to the end faces of the induction coils, the at least one portion having elevated winding density of the primary winding may be arranged eccentrically with respect to the core and the remaining winding region of the primary winding.

If the initial and final regions of the primary winding are configured as portions having elevated winding density, it is advantageous for the magnetic-field-constricting effect, to select an eccentricity arrangement that is offset radially by 180°.

BRIEF DESCRIPTION OF THE DRAWINGS

The invention is described in more detail hereinafter by means of the advantageous embodiments illustrated in the accompanying drawings. Similar or corresponding details of the subject of the invention are provided with the same reference numerals. In the drawings.

DETAILED DESCRIPTION OF THE EMBODIMENTS

Figure 1:
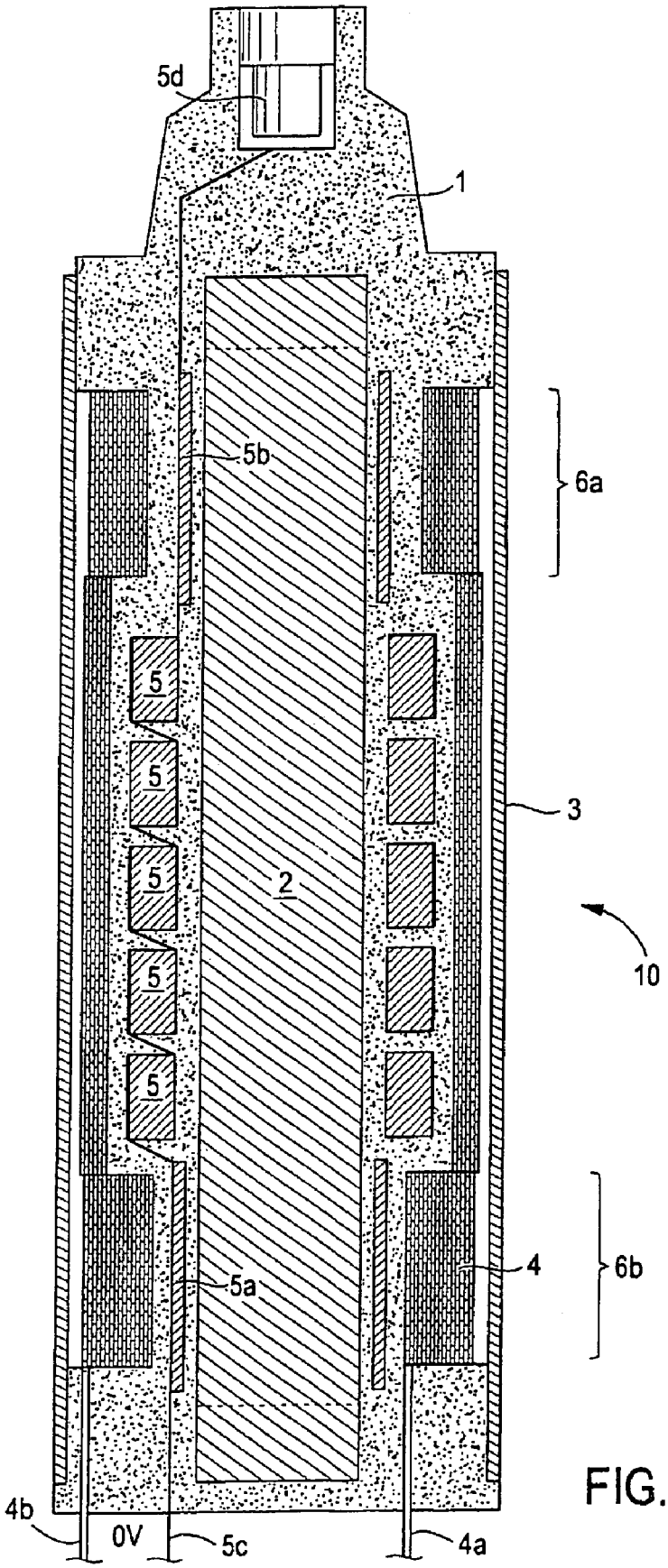
FIG. 1 is a section of an ignition coil according to the invention according to a first embodiment.

FIG. 1 is a longitudinal section through a first embodiment of an ignition coil 10 according to the invention. As shown in this schematic view, approximately 45% of the ignition coil 10 consists of highly effective insulating material 1, which is usually produced from plastic material having electric strength of approximately 30 kV/mm and, in particular, electrically insulates the high-voltage-carrying secondary winding 5 from the remaining components.

The iron circuit, which comprises a soft-magnetic core 2 having high saturation induction and a soft-magnetic sleeve 3 forming the outer sleeve, which are both configured substantially over the full length of the ignition coil 10, takes up approximately 25% of the overall volume. The low-resistance primary winding 4 occupies a volume of approximately 20% and is therefore generally twice as great in volume as the high-resistance secondary winding 5 with a proportion of approximately 10% of the total volume.

As all components of the ignition coil 10 have to be greatly restricted in size in order to achieve this relatively small overall volume, the soft-magnetic core 2 is actually under-sized by an amount that can be compensated only in part by the fact that the iron circuit is configured to be magnetically open at the end faces. The result of this is that when a current is supplied to a conventional cylindrical primary coil with a uniform diameter, which is relatively great due to the insulation required, of its innermost windings, considerable magnetic flux leakages occur, which are not only lost from the useful flux, but also attenuate it further as the flux leakage partially counteracts the useful flux during the reduction in primary current. The entire internal space of the primary coil carries the magnetic flux as the iron core has to be operated entirely with magnetic saturation in order to ensure the necessary induction in the secondary winding. To increase the magnetic flux conversion, permanent magnets may be arranged at the end faces of the soft-magnetic core with opposite polarity to the magnetic field of the primary winding 4. A higher firing power is thus attainable, but may only be achieved with a corresponding increase in the primary current, so increased exposure to elevated temperatures occurs. The magnetic flux leakage cannot be reduced by this method; on the contrary, it is assumed that the magnetic flux leakage increases as a percentage, in particular at the final run-outs of the primary winding 4, due to the opposing polarity of the permanent magnets to the primary magnetic field.

According to the invention, therefore, the magnetic flux leakage is reduced, predominantly at the primary winding and in particular at the final run-outs thereof in that the final run-out of the primary winding 4 over a respective length of approximately 20% of the total length of the primary coil is reduced to at least half of the internal diameter in the remaining region and the magnetic field strength in these initial and final portions 6*a*, 6*b*, is at the same time substantially doubled by a greater number of turns than in the central region of the primary coil 4. The magnetic flux per unit area can therefore be substantially doubled in these portions 6*a*, 6*b*.

According to the invention, the secondary winding 5 is arranged in the cavity-forming central region of the primary winding 4, and its terminal ends 5*c*, 5*d* are embedded securely in the insulating material 1 and are guided outwardly at the end face below the constricting turns.

An efficiency-increasing effect may be achieved by a one-sided formation of a region of reduced diameter and elevated winding density, the final run-out 6*b* of the primary winding 4 remote from the high voltage being preferred due to the advantages in terms of insulation.

The magnetic field emanating from the primary winding 4 is divided into a portion in the soft-magnetic core 2, which forms the main field component, and a parallel portion, of which the volume is limited, on the one hand, by the innermost turns of the primary winding 4 and, on the other hand, by the surface of the soft-magnetic core 2. The cross-section of this parallel volume is greater than the cross-section of the core 2, not least because of the thick insulation walls, and a considerable increase in power is consequently possible due to the almost complete use also of this magnetic field for energy transfer to the secondary winding 5. Due to the magnetic-field-constricting effect and the increase in the magnetic field strength, resulting from the greater number of turns, the magnetic resistance at the magnetically open ends of the iron circuit may be compensated, on the one hand, and the primary magnetic field is able to penetrate the secondary winding 5 to substantially greater extents, in order also to utilize this magnetic field content effectively during energy transfer.

In the illustrated embodiment (as in the second embodiment in FIGS. 4 and 5), the secondary winding 5 is divided into individual segments, as is usually necessary for reasons of electric strength. This segmentation has a reducing effect on the counter-induction during discharge of the secondary current. This results in a reduced period of action (firing time) of the current discharge, which may be critical for reliable ignition of the combustible gas molecules, particularly if an inhomogeneous gas mixture or a non-ideal mixing ratio is present, as may be case, for example, in the engine starting phase or in an alternating phase of the engine power.

Therefore, as shown in FIG. 1, the secondary winding 5 is configured with a comparatively small number of segments (for example five here) in a coil height which is as great as possible. The insulation strength within a segment may be maintained by a smaller coil width. To ensure the insulation strength toward the primary winding while maintaining the smallest volume occupancy, the coil heights of the secondary segment windings are configured so as to decrease in coil height in the manner of a cascade. The wall thicknesses of the insulation toward the primary winding 4 are increased according to the increasing high voltage from segment to segment. A greater coil height of the secondary winding segments also increases the positive effect of the principle according to the invention of a constricted primary winding in that the configuration of a primary winding with greater diameter differences between the central region and the constricted region is possible and the secondary winding is surrounded even more intensively on three sides by the primary winding 4.

Figure 2:
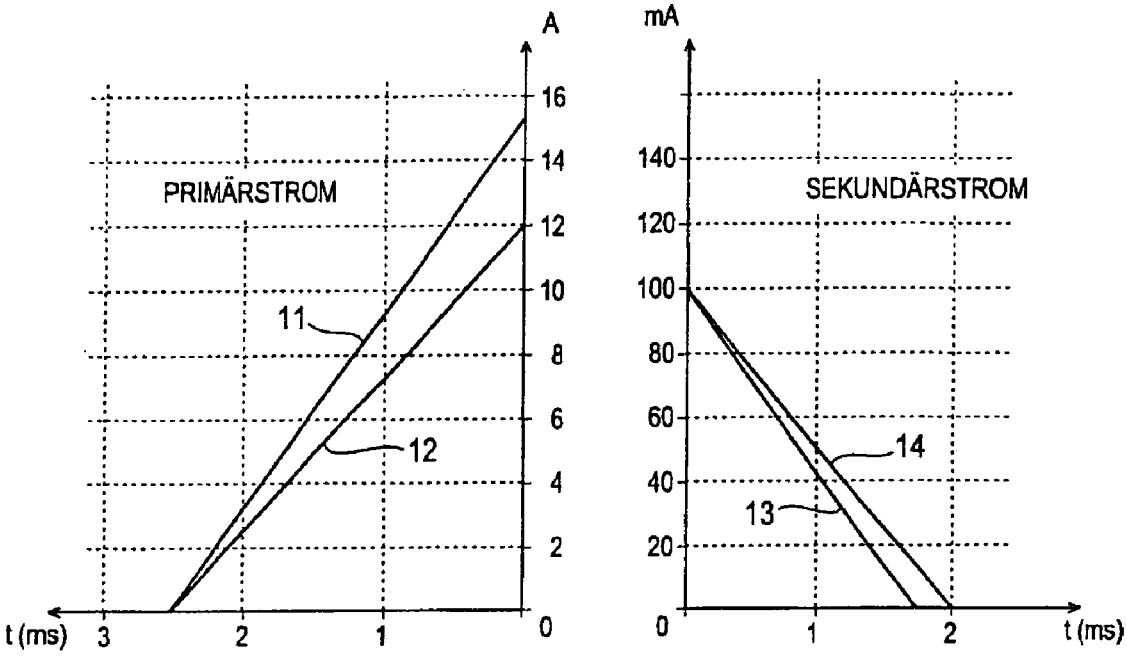
FIG. 2 shows the current curves over time of the primary side and secondary side of an ignition coil according to the invention in comparison with a conventional ignition system.

FIG. 2 shows the electrical characteristics of an ignition coil configured with the features according to the invention in comparison with known ignition systems of the same category as a current graph. The curves 11 and 13 represent the primary-side and secondary-side current curve on a conventional ignition coil and the curves 12 and 14 the primary-side and secondary-side current curve on an ignition coil configured according to the present invention. As shown in the graph, the primary current curve corresponds characteristically to the secondary current curve with the difference that the primary current has an ascending curve, the secondary current, on the other hand, a descending curve, offset in time, and the associated current strengths behave according to the product of current strength and number of turns. Otherwise, the characteristic of the current curves is an exact mirror image, due to the common magnetic circuit.

Figure 3:
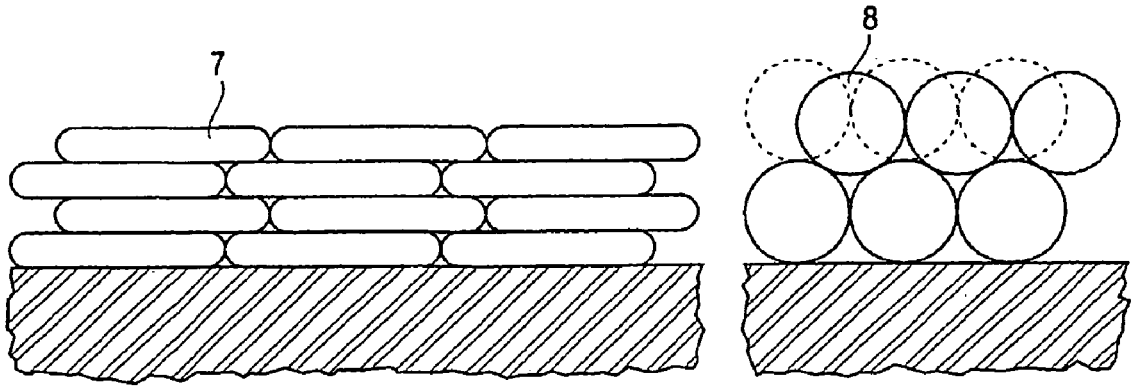
FIG. 3 is a schematic section of a flat wire winding in comparison with a round wire winding.

A further increase in the magnetic-field-constricting effect of the portions 6 with elevated winding density and reduced diameter is obtained with unchanged maintenance of the necessary insulation wall thicknesses in that the primary coil 4 is configured as a flat wire winding rather than a conventional round wire winding. As shown schematically in FIG. 3, the magnetic flux-constricting effect of the flat wire winding is considerable, in particular in comparison with a round wire diameter of approximately 0.7 mm conventionally used in primary windings. If, for example, instead of a round wire having a diameter of 0.7 mm, a flat wire which is approximately 0.3 mm thick and has the same cross-sectional area as the round wire is used, the magnetic field may be constricted by about 15% and the efficiency of energy transfer increased by a similar order. This is due, in particular, to the increased current density in this arrangement. As also shown in FIG. 3, the individual flat wire windings make contact in a substantially greater surface region and therefore ensure a better outflow of heat.

Figure 4:
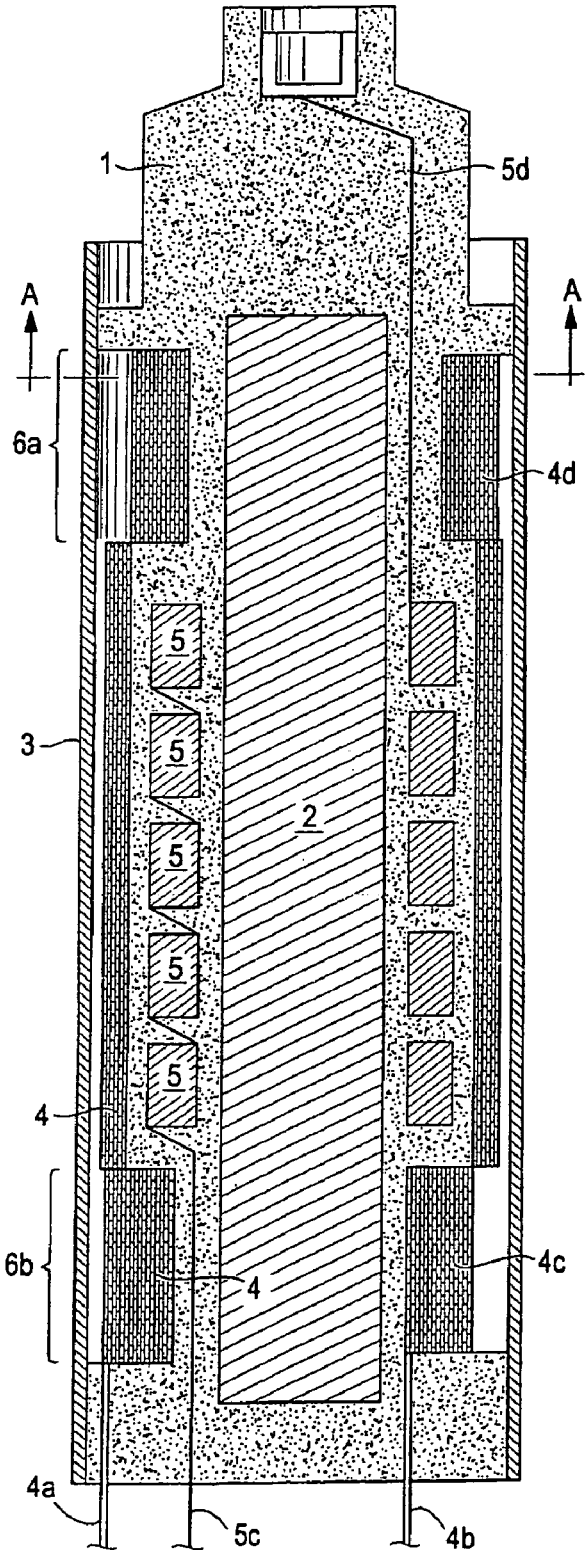
FIG. 4 is a section of an ignition coil according to the invention according to a second embodiment.
Figure 5:
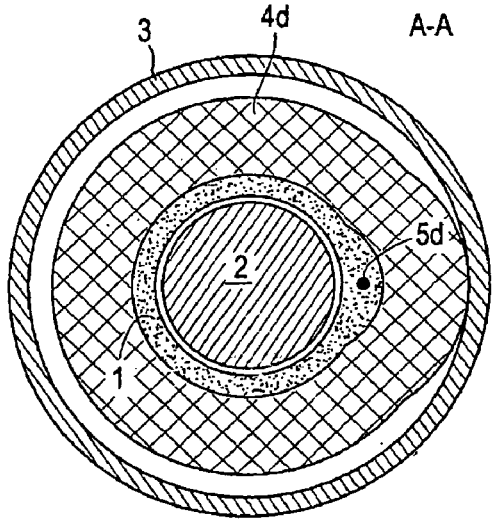
FIG. 5 is a section through the ignition coil of FIG. 4 along section line A-A.

The magnitude of the magnetic-field-constricting effect may be increased, as shown in FIG. 4, in that the final run-outs of the secondary winding 5*c* and 5*d* are guided over the shortest path in an axial direction to the end faces of the ignition coil 10. Therefore, the relatively thick insulation walls round the core are no longer required and partial insulation in the region of the lead-throughs of the secondary terminal ends 5*c* and 5*d* is merely required. The solid surrounding formation of the insulation 3 in a wide region is therefore dispensed with on the core 2. In this embodiment, the constricting portions 6*a*, 6*b* are no longer arranged concentrically to the center line of the soft-magnetic core 2 and the remaining central region of the primary winding 4. However, a significant proportion of the primary windings are guided closer to the iron core than in the embodiment of FIG. 1, and a corresponding increase in the magnetic constriction effect can thus be achieved. The arrangement, which is radially mutually offset by 180° and is shown in FIG. 4 and the associated section in FIG. 5, of the eccentricity of the constricting portions 6*a*, 6*b* of the primary winding is advantageous for the constricting effect.

Although only cylindrical ignition coils have been shown hereinbefore, the present invention is obviously applicable to any other cross-section, for example to a rectangular cross-section. Furthermore, the present invention can also advantageously be used with other transformers, in particular in those with a reduced volume of iron core.

The invention claimed is:

1. An ignition coil for ignition systems, in particular a rod ignition coil for internal-combustion engines, comprising:

at least one primary winding and at least one secondary winding, a high voltage being induced in the secondary winding when current flows in the primary winding, a ferromagnetic core which is surrounded at least in part by the primary winding and the secondary winding, one of the windings additionally being surrounded at least in part by the other, at least the winding that at least in part surrounds the other winding comprises at least one portion having a winding density that is greater than the remaining winding density, a diameter of innermost turns being smaller in the at least one portion than a diameter of the innermost turns in the remaining winding portions.

2. The ignition coil according to claim 1, wherein the secondary winding is so arranged relative to the primary winding that each portion having elevated winding density on one winding corresponds to a portion with the remaining winding density on the other winding in the axial direction.

3. The ignition coil according to claim 1, wherein at least one of the windings is a flat wire winding.

4. The ignition coil according claim 3, wherein a soft-magnetic sleeve surrounds the windings and the core.

5. The ignition coil according to claim 1, wherein the primary winding surrounds the secondary winding and the at least one portion having elevated winding density is an initial and/or final portion of the primary winding and the secondary winding is arranged in the remaining winding portion of the primary winding.

6. The ignition coil according to claim 5, wherein the secondary winding further comprises a pre-winding and/or final winding having reduced winding density, which is surrounded by the initial and/or final portion of the primary winding.

7. The ignition coil according claim 5, wherein the secondary winding is divided into a plurality of individual segments.

8. The ignition coil according to claim 7, wherein coil heights of the individual segments are configured to decrease in the manner of a cascade.

9. The ignition coil according to claim 5, wherein the at least one portion having elevated winding density is arranged eccentrically with respect to the center line of the ignition coil.

10. The ignition coil according to claim 9, wherein the initial portion and the final portion of the primary coil are arranged offset eccentrically substantially by 180° with respect to the center line of the ignition coil.

11. An ignition coil comprising:

a ferromagnetic core;

a primary winding being wound around the core;

a secondary winding being wound around the core, such that one of the windings at least partially surrounds the other;

at least one portion of at least the winding that at least partially surrounds the other winding having a winding density that is greater than the remaining winding density, wherein the diameter of innermost turns is smaller in the at least one portion than the diameter of the innermost turns in the remaining winding portions;

whereby a high voltage is induced in secondary winding when current flows in the primary winding.

12. The ignition coil according to claim 11, wherein the secondary winding is arranged relative to the primary winding such that each portion having greater winding density on one winding corresponds to a portion with the remaining winding density on the other winding in the axial direction.

13. The ignition coil according claim 12, wherein the primary winding surrounds the secondary winding and the at least one portion having greater winding density is an initial or final portion of the primary winding and the secondary winding is arranged in the remaining winding portion of the primary winding.

14. The ignition coil according to claim 13, wherein the secondary winding further comprises a pre-winding or final winding having reduced winding density, which is surrounded by the initial or final portion of the primary winding.

15. The ignition coil according to claim 14, wherein at least one of the windings is a flat wire winding.

16. The ignition coil according to claim 15, wherein a soft-magnetic sleeve surrounds the windings and the core.

17. The ignition coil according to claim 16, wherein the secondary winding is divided into a plurality of individual segments.

18. The ignition coil according to claim 17, wherein coil heights of the individual segments are configured to decrease in the manner of a cascade.

19. The ignition coil according to claim 18 wherein the at least one portion having greater winding density is arranged eccentrically with respect to the center line of the ignition coil.

20. The ignition coil according to claim 19, wherein the initial portion and the final portion of the primary coil are arranged offset eccentrically substantially by 180° with respect to the center line of the ignition coil.

* * * * *

UNITED STATES PATENT AND TRADEMARK OFFICE

CERTIFICATE OF CORRECTION

PATENT NO. : 7,280,023 B2
APPLICATION NO. : 10/528133
DATED : October 9, 2007
INVENTOR(S) : Horst Hendel It is certified that error appears in the above-identified patent and that said Letters Patent is hereby corrected as shown below:

Col. 8, line 25;
In claim 4, line 1, "ignition coil according claim" should read --ignition coil according to claim--.

Col. 8, line 38;
In claim 7, line 1, "ignition coil according claim" should read --ignition coil according to claim--.

Col. 9, line 6;
In claim 13, line 1, "ignition coil according claim" should read --ignition coil according to claim--.

Signed and Sealed this

First Day of April, 2008

JON W. DUDAS
*Director of the United States Patent and Trademark Office*